US007812737B1

(12) United States Patent
Hunter

(10) Patent No.: US 7,812,737 B1
(45) Date of Patent: Oct. 12, 2010

(54) APPARATUS, METHOD, AND COMPUTER PROGRAM PRODUCT FOR CONDITIONALLY ACTUATING AN ILLUMINATOR, BASED ON A CONNECTOR STATUS

(75) Inventor: Matthew A. Hunter, San Jose, CA (US)

(73) Assignee: NVIDIA Corporation, Santa Clara, CA (US)

( * ) Notice: Subject to any disclaimer, the term of this patent is extended or adjusted under 35 U.S.C. 154(b) by 317 days.

(21) Appl. No.: 11/950,338

(22) Filed: Dec. 4, 2007

(51) Int. Cl.
*G08B 21/00* (2006.01)

(52) U.S. Cl. ..... 340/687; 361/760; 439/490

(58) Field of Classification Search ..... 340/687, 340/635, 653, 656, 686.4; 361/760, 778, 361/779; 439/488–491
See application file for complete search history.

(56) References Cited

U.S. PATENT DOCUMENTS 5,754,112 A * 5/1998 Novak ..... 340/635
6,095,851 A * 8/2000 Laity et al. ..... 439/490
6,159,037 A * 12/2000 Madsen et al. ..... 439/488
6,257,906 B1 * 7/2001 Price et al. ..... 439/490
6,337,633 B1 * 1/2002 Foseide ..... 340/687
6,457,992 B2 * 10/2002 Posey et al. ..... 439/490
6,850,417 B2 * 2/2005 Cooper et al. ..... 361/752
6,919,813 B2 * 7/2005 Barr et al. ..... 340/687
7,259,683 B2 * 8/2007 Abe ..... 340/635
7,262,706 B2 * 8/2007 Yang et al. ..... 340/656
7,605,707 B2 * 10/2009 German et al. ..... 340/687
2006/0208884 A1 * 9/2006 Diamant ..... 340/687

* cited by examiner

*Primary Examiner*—John A Tweel, Jr.
(74) *Attorney, Agent, or Firm*—Zilka-Kotab, PC

(57) ABSTRACT

An apparatus, method, and computer program product are provided for conditionally actuating an illuminator, based on a connector status. In use, a status is determined for a connector adapted for being releasably connected to an input line. Further, an illuminator is conditionally actuated, based on the status.

19 Claims, 7 Drawing Sheets

APPARATUS, METHOD, AND COMPUTER PROGRAM PRODUCT FOR CONDITIONALLY ACTUATING AN ILLUMINATOR, BASED ON A CONNECTOR STATUS

FIELD OF THE INVENTION

The present invention relates to connectors, and more particularly to conveying a status of a connector.

BACKGROUND

Connectors are utilized in a variety of environments. Just by way of example, in the computer arts, connectors are often used to provide power connectivity to an associated graphics card. To date, audible indicators have been used to notify a user when such power connectivity is lacking. Unfortunately, such audible indicators can be irritating and do not necessarily convey status information in an effective manner.

There is thus a need for addressing these and/or other issues associated with the prior art.

SUMMARY

An apparatus, method, and computer program product are provided for conditionally actuating an illuminator, based on a connector status. In use, a status is determined for a connector adapted for being releasably connected to an input line. Further, an illuminator is conditionally actuated, based on the status.

DETAILED DESCRIPTION

Figure 1:
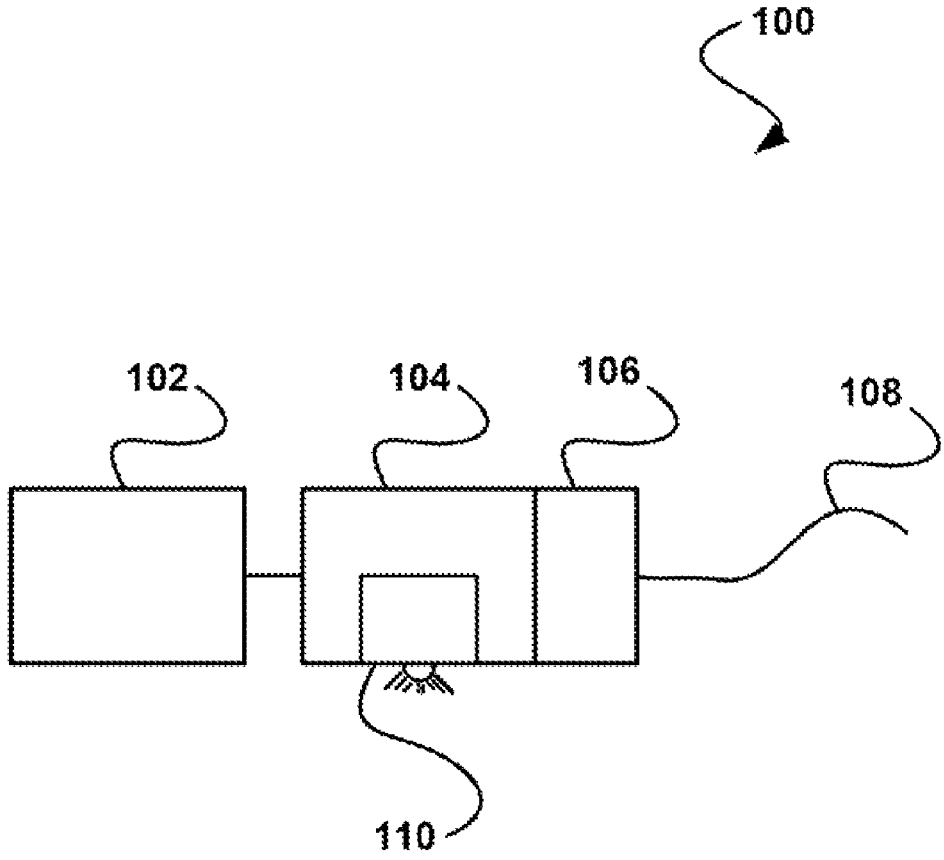
FIG. 1 shows an apparatus for conditionally actuating an illuminator, based on a connector status, in accordance with one embodiment.

FIG. 1 shows an apparatus 100 for conditionally actuating an illuminator, based on a connector status, in accordance with one embodiment. As shown, a connector 104 is provided which may include any component capable of being releasably connected to an input line 108. As an option, the connection provided by the connector 104 may include any combining, joining, merging, plugging in, inserting, securing, etc.

In one embodiment, the connector 104 may be releasably connected with another connector 106 of the input line 108. Just by way of example, the connector 104 may include a base connector and/or the other connector 106 may include a plug connector. As another example, the connector 104 may include the plug connector and/or the other connector 106 may include the base connector. To this end, the base connector may accept the plug connector, thus providing a connection therebetween.

In various embodiments, the connector 104 and the other connector 106 may each include an audio connector, a video connector, a power connector, an electrical connector, a data connector, etc. Optionally, the connector 104 and the other connector 106 may each be a component of a device (e.g. computer, graphics card, power supply, etc.).

As noted above, the other connector 106 may be coupled to the input line 108. In this way, the connector 104 may be releasably connected to the input line 108, via the other connector 106, in one embodiment. While only a single input line 108 is shown, it should be noted that the other connector 106 may also be coupled to a plurality of input lines. Further, in another embodiment, the input line 108 may include a power input line. As an option, the power input line may include any input line capable of providing power. For example, the input line 108 may include a ground power line, a positive power line, a negative power line, a control power line, and/or a status power line, etc.

In another embodiment, the input line 108 may include a data input line. For example, the data input line may include any line capable of providing data. In various embodiments, the data input line may be associated with providing a network connection, a video connection, an audio connection, a device connection, and/or any other data line associated with providing a data input and/or output connection. To this end, the other connector 106 coupled to data line may optionally include a universal serial bus (USB) connector, a digital video interface (DVI) connector, a high definition multimedia interface (HDMI) connector, a Sony™ Phillips digital interface (SPDIF) connector, an Institute of Electrical and Electronics Engineers 1394 (IEEE 1394 or Firewire) connector, an advanced technology attachment (ATA) connector, a serial advanced technology attachment (SATA) connector, a tip, ring, and sleeve (TRS) connector, a Radio Corporation of America (RCA™) connector, a separate video (S-Video) connector, a Bayonet Neill-Concelman (BNC) connector, etc. Of course, it should be noted that the input line 108 may include any input line capable of being releasably connected to the connector 104.

Still yet, a circuit 102 is coupled to the connector 104. As an option, the circuit 102 may include an integrated circuit and/or discrete components. In various embodiments, the circuit 102 may include digital and/or analog components. As another option, the circuit 102 may be included in the device associated with the connector 104, such as a computer, graphics card, etc. Thus, the circuit 102 may remain in communication with such device.

Further, in another embodiment, the circuit 102 may be capable of determining a status of the connector 104. Optionally, the status may include any information, state, condition, quality, etc. associated with the connector 104. For example, the status may reflect connectivity with the input line 108 (e.g. whether the connector 104 is connected to the input line 108, etc.).

As another example, the status may indicate whether the connector 104 is connected with the other connector 106. As an option, the status may indicate the quality of the connection between the connector 104 and the other connector 106.

For example, the quality may refer to aspects, attributes, characteristics, features, parameters, properties, traits, etc. of the connection. Accordingly, the status of the connector 104 adapted for being releasably connected to the input line 108 may be determined.

Furthermore, as shown, an illuminator 110 is associated with the connector 104. While only a single illuminator 110 is shown, it should be noted that a plurality of illuminators may also be associated with the connector 104, in another embodiment. In various embodiments, the connector 104 may be clear, translucent, opaque, etc.

In one embodiment, the illuminator 110 may be internal to the connector 104. As an option, the connector 104 may be molded to include the illuminator 110. Further, in another embodiment, the illuminator 110 may be external to the connector 104. Optionally, the illuminator 110 may be positioned on at least one side of the connector 104.

In the context of the present description, the illuminator 110 may include any device capable of providing illumination. For example, such illumination may include emitting, releasing, giving off, producing, emanating, discharging, etc. any sort of light. As an option, the light may include visible light. For example, the visible light may include any light in the visible spectrum. Further, in the context of the current example, the visible light may include red light, orange light, yellow light, green light, blue light, indigo light, violet light, white light, and/or any combination of the aforementioned visible lights.

Thus, the illuminator 110 may include at least one light. Just by way of example, the illuminator 110 may include a light-emitting diode (LED). Optionally, the LED may include an organic light-emitting diode (OLED), a polymer light-emitting diode (PLED), a flashing light-emitting diode (FLED), etc. In yet another embodiment, the illuminator 110 may include an incandescent light. As an option, the incandescent light may include a halogen light, a parabolic aluminized reflector, etc. In still yet another embodiment, the light may include a fluorescent light. For example, the fluorescent light may include a compact fluorescent (CFL) light, a linear fluorescent light, and/or an induction lamp, etc. Further, in one embodiment, the illuminator 110 may include a gas discharge light (e.g. a high-intensity discharge (HID) light, a hydrargyrum medium-arc iodide (HMI) light, a mercury-vapor light, a metal-halide, a neon light, a sodium vapor light, a xenon arc light, etc.).

Additionally, in another embodiment, the light of the illuminator 110 may include a plurality of different lights (e.g. of different colors, etc.). As an option, the plurality of different lights may each have at least one connection to the illuminator 110. For example, the connection may include a plurality of pins, leads, etc. accessible with respect to the light. In yet another embodiment, the plurality of different lights may have a set of common connections to the illuminator 110. For example, the set of common connections may include a plurality of pins, leads, etc. accessible for the plurality of different lights.

Still yet, in another embodiment, the illuminator 110 may be conditionally actuated based on the determined status of the connector 104. As an option, the actuating may include activating, driving, energizing, turning on, signaling, etc. the illuminator 110. For example, the illuminator 110 may be actuated in response to a determination that the status of the connector 104 includes a disconnected status (e.g. indicating that the connector 104 is disconnected from the input line 108, etc.). Of course, in another embodiment, the illumination may indicate a connected status. In addition, in yet another embodiment, the illuminator 110 may illuminate the connector 104. For example, the connector 104 may be translucent, such that actuating the illuminator 110 result in illumination of the connector 104.

Optionally, the illuminator 110 may be actuated with different colors, based on the status. Thus, the illuminator 110 may be color-coded. Just by way of example, the illuminator 110 may illuminate a first predefined color (e.g. red, etc.) when the connector 104 is disconnected from the input line 108. Further, the illuminator 110 may illuminate a second predefined color (e.g. green, etc.) when the connector 104 is connected to the input line 108. In this way, the illuminator 110 may reflect connectivity between the connector 104 and the input line 108, a quality of such connectivity, etc.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
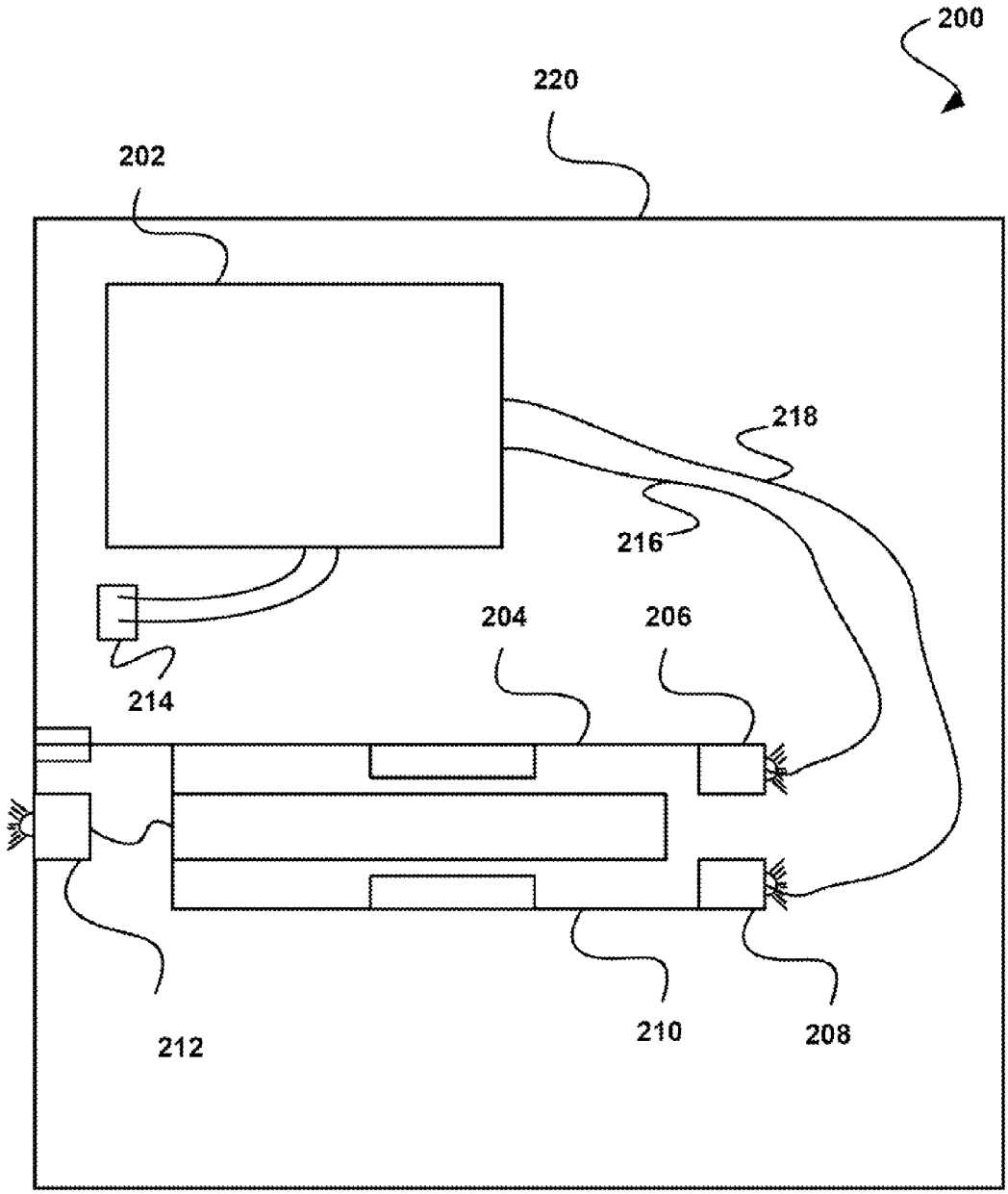
FIG. 2 shows a system for conditionally actuating a plurality of illuminators, each actuated based on a different connector status, in accordance with another embodiment.

FIG. 2 shows a system 200 for conditionally actuating a plurality of illuminators, each actuated based on a different connector status, in accordance with another embodiment. As an option, the system 200 may be implemented in the context of the apparatus 100 of FIG. 1. Of course, however, the system 200 may be implemented in any desired environment. It should also be noted that the aforementioned definitions may apply during the present description.

As shown, the system 200 includes a motherboard 220 with a plurality of associated components. In one embodiment, the motherboard 220 may be associated with a power supply 202. As an option, the power supply 202 may be utilized for converting a source alternating current (AC) to an output direct current (DC). For example, the source alternating current may include a 120 volt alternating current, and/or any other voltage value associated with the source alternating current. Still yet, in another example, the output direct current may include a 12 volt direct current, and/or other any other voltage value associated with the output direct current.

Optionally, the power supply 202 may be external to the motherboard 220. Further, as yet another option, the power supply 202 may include at least one output for supplying power. In one embodiment, the power supply 202 may be coupled to a connector 214 associated with the motherboard 220. Thus, the power supply 202 may supply power to the motherboard 220 via the connector 214. Optionally, the motherboard 220 may distribute power from the power supply 202 to a plurality of components coupled to the motherboard 220.

In yet another embodiment, the plurality of components may be coupled to the motherboard 220 via a plurality of slots, ports, connectors, etc. associated with the motherboard 220. As an option, the slots may include a peripheral component interconnect (PCI) slot, a PCI Express slot, an accelerated graphics port (AGP) slot, a video electronics standards association (VESA) slot, an industry standard architecture (ISA) slot, and/or any other slot capable of being utilized for coupling a component to the motherboard 220. As an option, a first card 204 may be coupled to the motherboard 220 via a first slot associated with the motherboard 220. In addition, as yet another option, a second card 210 may be coupled to the motherboard 220 via a second slot associated with the motherboard 220. Optionally, the first card 204 may receive power from the power supply 202 via the first slot. Further, as still yet another option, the second card 210 may receive power from the power supply 202 via the second slot.

As an option, the first card 204 and/or the second card 210 may each include a graphics card, a network card, a physics card, a redundant array of independent drives (RAID) card, etc. Additionally, in one embodiment, the first card 204 and the second card 210 may be in communication. For example, the second card 210 may include a daughter card coupled to the first card 204. Optionally, the first card 204 and the second card 210 may be coupled via a scalable link interface (SLI), a cable, a bridge card, and/or any other interface, cable, and/or card capable of coupling the first card 204 and the second card 210.

Furthermore, as shown, the first card 204 includes a first connector 206. Of course, however, the first card 204 may also be coupled to the first connector 206. As an option, the first connector 206 may include a first illuminator. Still, in yet another embodiment, the second card 210 includes and/or is coupled to a second connector 208. As an option, the second connector 208 may include a second illuminator.

In one embodiment, the power supply 202 may include a first power output line 216. As an option, the first power output line 216 may be releasably coupled to the first connector 206 associated with the first card 204. For example, the first card 204 may receive power from the first power output line 216, such that the first power output line 216 may include a first power input line for the first card 204 of the motherboard 220.

In another embodiment, the first card 204 may include a first circuit for determining a first status of the first connector 206. Further, another embodiment, the first status may reflect connectivity between the first connector 206 and the first power output line 216. As an option, reflecting may include indicating, demonstrating, communicating, displaying, showing, etc. For example, the first status may reflect that the first connector 206 and the first power output line 216 are fully connected, partially connected, or disconnected.

As another example, the first status may reflect whether a voltage of the first power output line 216 falls within a predetermined range. For example, an under-voltage may occur if a voltage is below a low end of the range. Further, as yet another example, an over-voltage may occur if the voltage is above a top end of the range. As an option, the predetermined range may be determined automatically (e.g. by software, hardware, etc.) or manually (e.g. by a user, etc.).

In still yet another embodiment, based on the first status, the first circuit may actuate the first illuminator of the first connector 206. As an option, the first illuminator may be actuated with a different color based on the status. For example, the actuating may include illuminating a green light via the first illuminator if the voltage associated with the first power output line 216 is within the predetermined range and/or if the first connector 206 and the first power output line 216 are connected. Further, as yet another example, the actuating may include illuminating a red light via the first illuminator if the voltage associated with the first power output line 216 is outside of the predetermined range and/or if the first connector 206 and the first power output line 216 are partially connected or disconnected.

In another embodiment, the power supply 202 may include a second power output line 218. As an option, the second power output line 218 may be releasably coupled to the second connector 208 associated with the second card 210. For example, the second card 210 may receive power from the second power output line 218, such that the first power output line 216 may include a first power input line for the first card 204 of the motherboard 220.

Additionally, the second card 210 may include a second circuit for determining a second status of the second connector 208. For example, the second status may reflect connectivity between the second connector 208 and the second power output line 218. In this way, the second status may optionally reflect whether the second connector 208 and the second power output line 218 are connected, partially connected, or disconnected. As another example, the second status may reflect whether a voltage associated with the second power output line 218 falls within a predetermined range. In one embodiment, the predetermined range may be the same as that described above with respect to the first power output line 216, but of course may also be different than such first power output line 216.

In still yet another embodiment, based on the second status, the second circuit may actuate the second illuminator of the second connector 208. As an option, the second illuminator may be actuated with a different color based on the status. For example, the actuating may include illuminating a green light via the second illuminator if the voltage associated with the second power output line 218 is within the predetermined range and/or if the second connector 208 and the second power output line 218 are connected. Further, as yet another example, the actuating may include illuminating a red light via the second illuminator if the voltage associated with the second power output line 218 is outside of the predetermined range and/or if the second connector 208 and the second power output line 218 are partially connected or disconnected.

To this end, a pair of connectors 206 and 208 may be included in the system 200, where each is adapted for being releasably connected to a corresponding power output line 216 and 218. Further, a pair of illuminators, each associated with such connectors 206 and 208, may be conditionally actuated based on the status of each of such connectors 206 and 208.

Further, in one embodiment, the first card 204 may include a backplate. Also, in another embodiment, the second card 210 may include a backplate. For example, the backplate may be utilized for securing the first card 204 and/or the second card 210 to the motherboard 220 and/or for stabilizing the first card 204 and/or the second card 210. As an option, the backplate may include at least one connector. For example, such connector may include a video cable connector.

As also shown, the backplate may be connected to a third illuminator 212. For example, the third illuminator 212 may be included on the connector of the backplate. In yet another embodiment, a third circuit may utilize the first status of the first connector 206 and the second status of the second connector 208 to determine a combined status of the first connector 206 and the second connector 208. While two connectors are described in the present embodiment, it should be noted that any number is feasible.

As an option, the third illuminator 212 may be conditionally actuated based on the combined status. For example, if both the first status and second status indicate that the voltages associated with the first power output line 216 and the second power output line 218 are within the predetermined range and/or that the respective connectors 206 and 208 and the respective power output lines 216 and 218 are connected, a green light of the third illuminator 212 may be illuminated. Otherwise, in the context of the current example, a red light of the third illuminator 212 may be illuminated.

Figure 3:
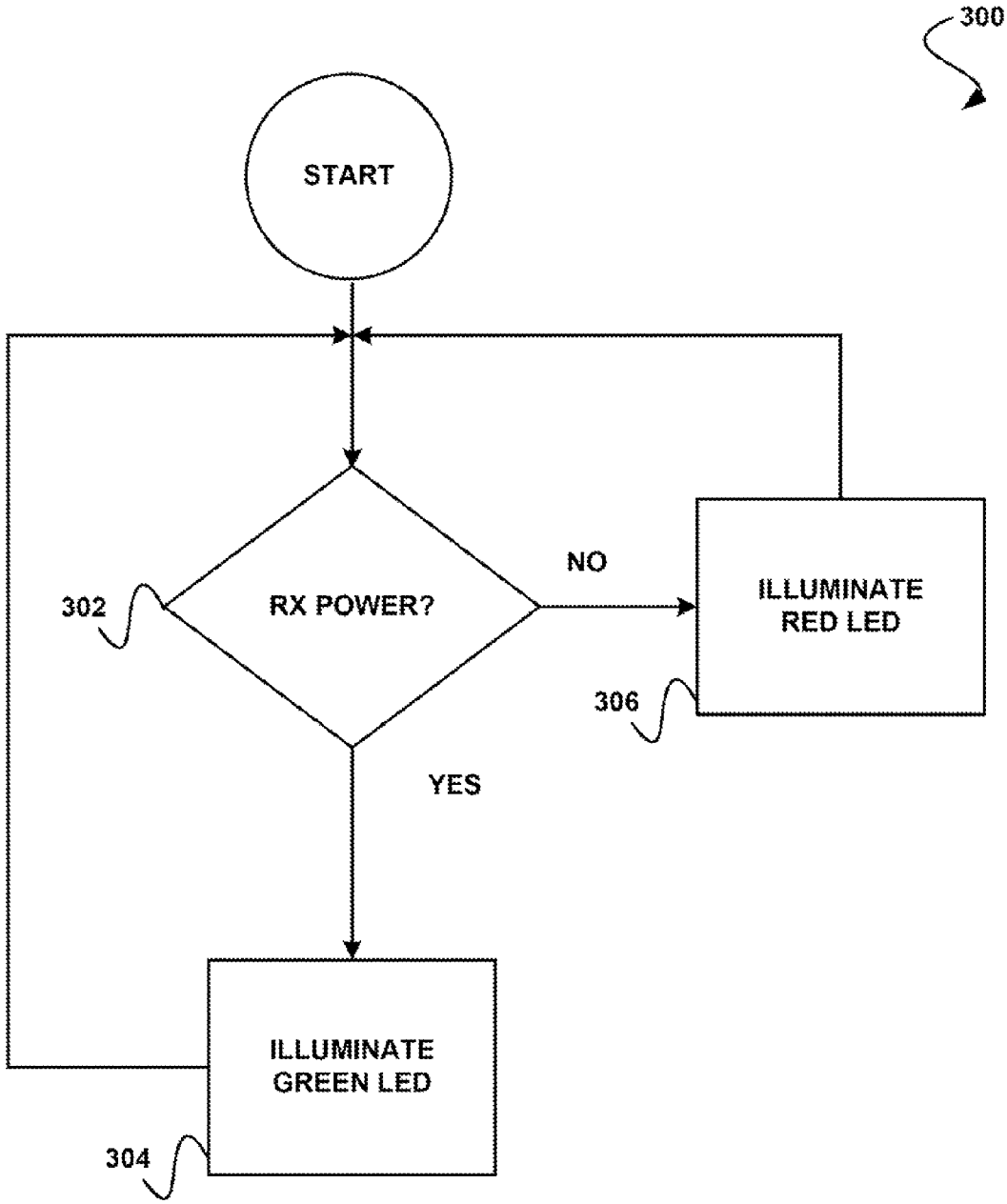
FIG. 3 shows a method for illuminating a color-coded light emitting diode, based on a power connector status, in accordance with yet another embodiment.

FIG. 3 shows a method 300 for illuminating a color-coded light emitting diode, based on a power connector status, in accordance with yet another embodiment. As an option, the present method 300 may be carried out in the context of the functionality and architecture of FIGS. 1-2. Of course, however, the method 300 may be carried out in any desired environment. Again, it should be noted that the aforementioned definitions may apply during the present description.

As shown in decision 302, it is determined whether power is received. In the context of the present embodiment, the power may include power from a power supply. Thus, the power may include voltage, etc. As an option, such determination may be performed via a circuit, such as the first circuit and/or second circuit of FIG. 2. Additionally, determining whether power is received may include determining whether power is presently being received, for example.

In one embodiment, the determination may include determining if power exists (e.g. at a connector, etc.). For example, if a connector is not connected to a power input line utilized for receiving power, then power may not exist at the connector. In another embodiment, the determination may include determining if the received power is within a predetermined range. Such predetermined range may include a voltage range, as an option.

As an option, the determination may be performed based on a predetermined interval, and/or as requested. As an option, the predetermined interval may include a manually configured time interval. Further, as yet another option, the determination may be performed in response to a hardware request and/or instruction. Optionally, the determination may be performed in response to a software request and/or instruction.

Further, as shown in operation 304, if it is determined that the power has been received, a green LED is illuminated. In addition, as shown in operation 306, if it is determined that the power has not been received, then a red LED is illuminated. The green LED and/or red LED may thus be illuminated for indicating a status of a connector connected to the power supply.

Figure 4:
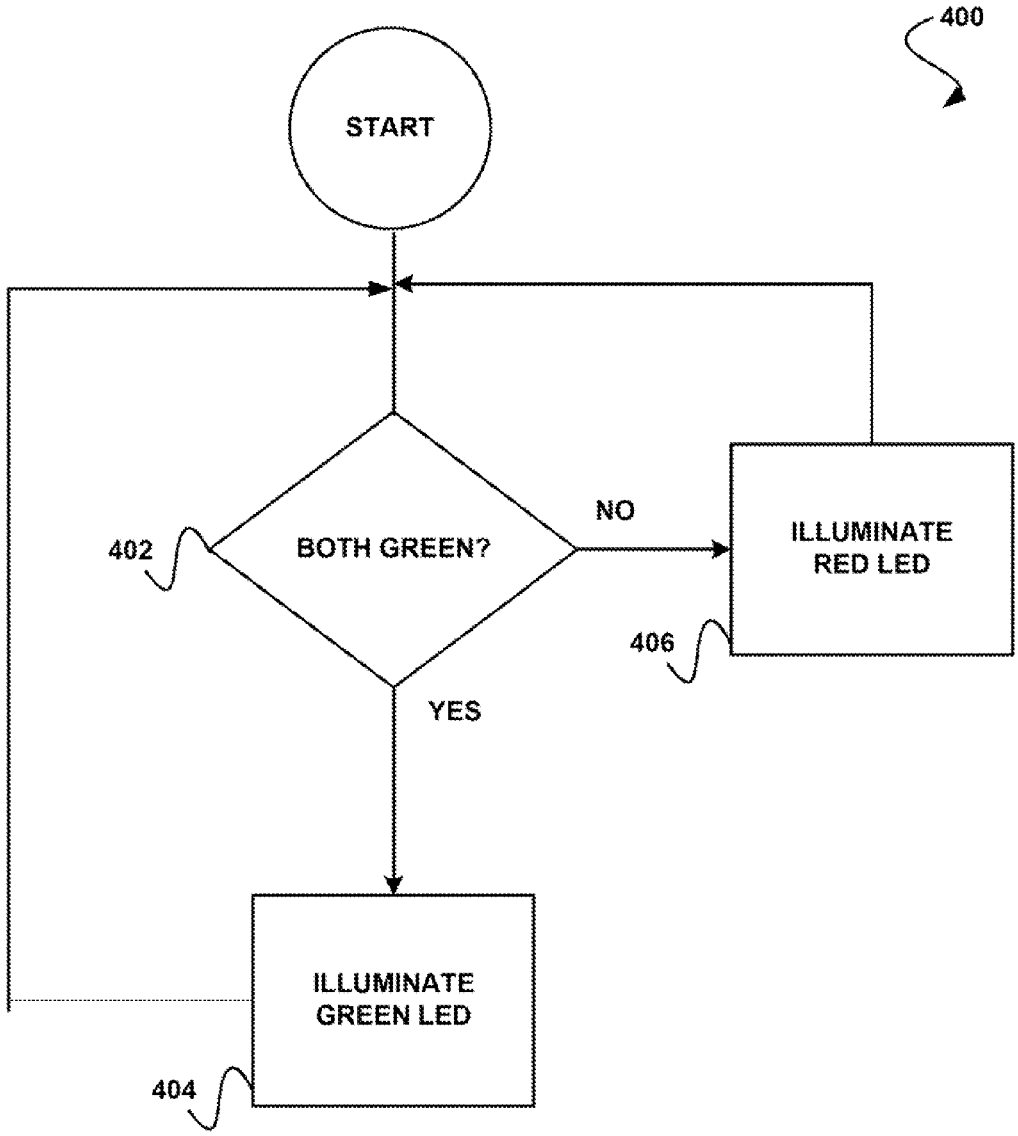
FIG. 4 shows a method for illuminating a color-coded light emitting diode, based on a combined connector status associated with two other color-coded light emitting diodes, in accordance with still yet another embodiment.

FIG. 4 shows a method 400 for illuminating a color-coded light emitting diode, based on a combined connector status associated with two other color-coded light emitting diodes, in accordance with still yet another embodiment. As an option, the method 400 may be carried out in the context of the functionality and architecture of FIGS. 1-3. Of course, however, the method 400 may be carried out in any desired environment. Again, it should be noted that the aforementioned definitions may apply during the present description.

As shown in decision 402, it is determined whether a green LED is illuminated for two illuminators. In the context of the present embodiment, each of the two illuminators may be used for indicating a status of an associated connector (e.g. whether an associated connector is connected to a power input line, etc.). Thus, each of the two illuminators may reflect whether power is received via the power input line.

As an option, a green LED or a red LED of each illuminator may be independently illuminated using the method 300 of FIG. 3. For example, the green LED may indicate that an associated connector is receiving power via an input power line. As another example, the red LED may indicate that an associated connector is not receiving power via an input power line. While only two illuminators are described herein, it should be noted that any number of illuminators may be utilized for the determination.

Further, as shown in operation 404, if it is determined the green LED is illuminated for both of the illuminators, then a green LED for a third illuminator is illuminated. In addition, as shown in operation 406, if it is determined that the green LED is not illuminated for both of the illuminators, then a red LED for the third illuminator may be illuminated. For example, if a green LED of a first illuminator is illuminated, and a red LED of a second illuminator is illuminated, then a red LED for the third illuminator may be illuminated. In this way, a third illuminator may be actuated based on a combined status of two connectors.

Figure 5:
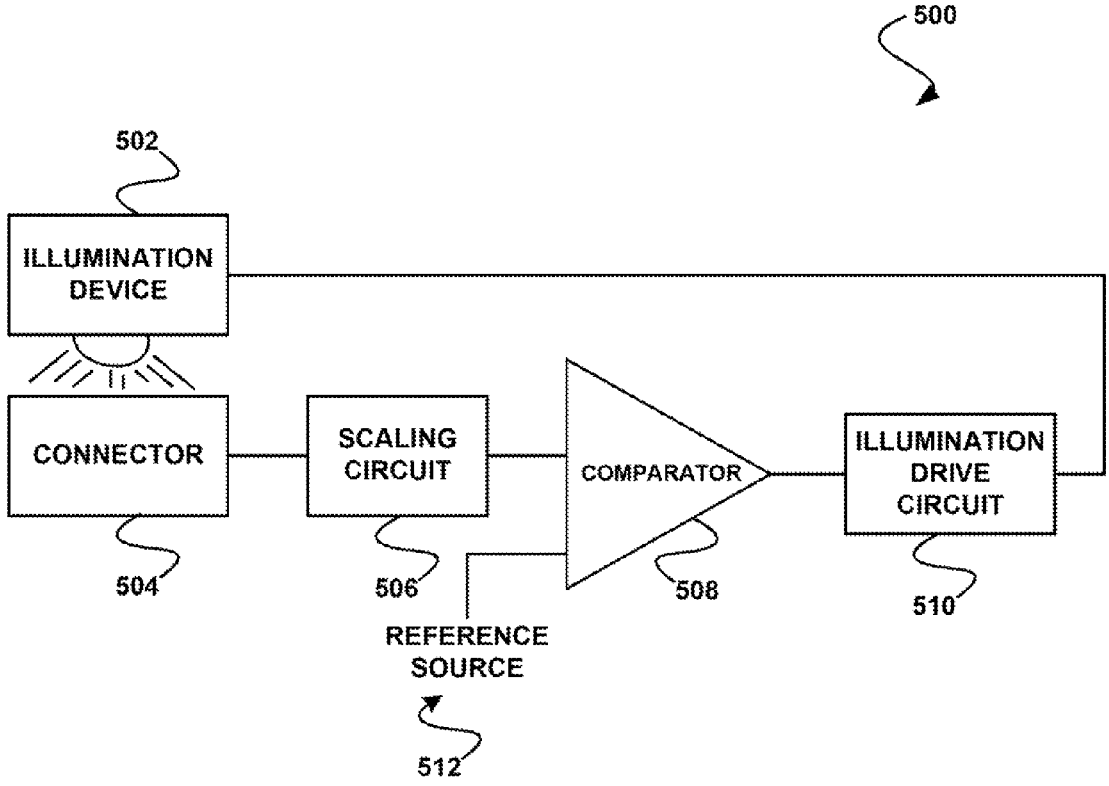
FIG. 5 shows an apparatus for actuating an illumination device utilizing an illumination drive circuit, in accordance with one embodiment.

FIG. 5 shows an apparatus 500 for actuating an illumination device utilizing an illumination drive circuit, in accordance with one embodiment. As an option, the apparatus 500 may be implemented in the context of the functionality and architecture of FIGS. 1-4. Of course, however, the apparatus 500 may be implemented in any desired environment. Yet again, it should be noted that the aforementioned definitions may apply during the present description.

As shown, the system 500 includes an illumination device 502. Further, the illumination device 502 may optionally illuminate a connector 504. For example, the connector 504 may be transparent for illumination thereof via the illumination device 502. Thus, when the illumination device 502 is actuated, the connector 504 may be illuminated. As an option, the illumination device 502 may be external to the connector 504. In addition, as yet another option, the illumination device 502 may be internal to the connector 504.

As also shown, the connector 504 is coupled to a scaling circuit 506. For example, the scaling circuit 506 may process an incoming signal from the connector 504. Optionally, the processing may include scaling the incoming signal from the connector 506. As an option, the scaling may include reducing or increasing the incoming signal. For example, the scaling may include reducing or increasing the incoming signal to an input range of a comparator 508. Further, the incoming signal may include a power signal, an audio signal, a data signal, etc. received by the connector 504 via an input line.

In yet another embodiment, the scaling circuit 506 is coupled to the comparator 508. For example, the comparator 508 may receive an output signal from the scaling circuit 506. As an option, the comparator 508 may compare the output signal received from the scaling circuit 506 against a signal associated with a reference source 512. Thus, the reference source 512 may indicate a predefined reference signal, such as a predefined reference voltage. For example, the predefined reference voltage may be 12 volts or any other voltage value.

In one embodiment, the reference source 512 may indicate the desired output signal from the scaling circuit 506. Furthermore, in one embodiment, the comparator 508 may compare the output signal received from the scaling circuit 506 to the signal associated with the reference source 512. Optionally, if the output signal received from the scaling circuit 506 falls within a range indicated by such signal associated with the reference source 512, the comparator 508 may output a signal indicating that the output signal from the scaling circuit 506 is within the range. Further, as yet another option, if the output signal received from the scaling circuit 506 falls outside the range indicated by the signal associated with of the reference source 512, the comparator 508 may output a signal indicating that the output signal from the scaling circuit 506 is outside of the range.

In addition, in another embodiment, the signal from the comparator 506 may instruct the illumination device 502 to provide a green illumination or a red illumination. Just by way of example, if the output signal received from the scaling circuit 506 falls within the range indicated by the signal associated with the reference source 512, the comparator 508 may output a signal indicating that the illumination device 502 is to actuate a green LED. As another example, if the output signal received from the scaling circuit 506 falls within outside of the range indicated by the signal associated with the reference source 512, the comparator 508 may output a signal indicating that the illumination device 502 is to actuate a red LED.

For example, the comparator 508 may be coupled to an illumination drive circuit 510. As an option, the illumination drive circuit 510 may receive the signal from the comparator 508. Further, as yet another option, the illumination drive circuit 510 may provide additional power necessary to actuate the illumination device 502. For example, if the illumination device 502 requires additional power beyond what is provided by the signal received from the comparator 508, the illumination drive circuit may be utilized to provide additional power to the illumination device 502. Still, in yet another embodiment, the illumination device 502 may receive the signal from the comparator 508 via the illumination drive circuit 510. Optionally, after receiving the signal, the illumination device 502 may illuminate a red LED or a green LED, based on the signal.

Figure 6:
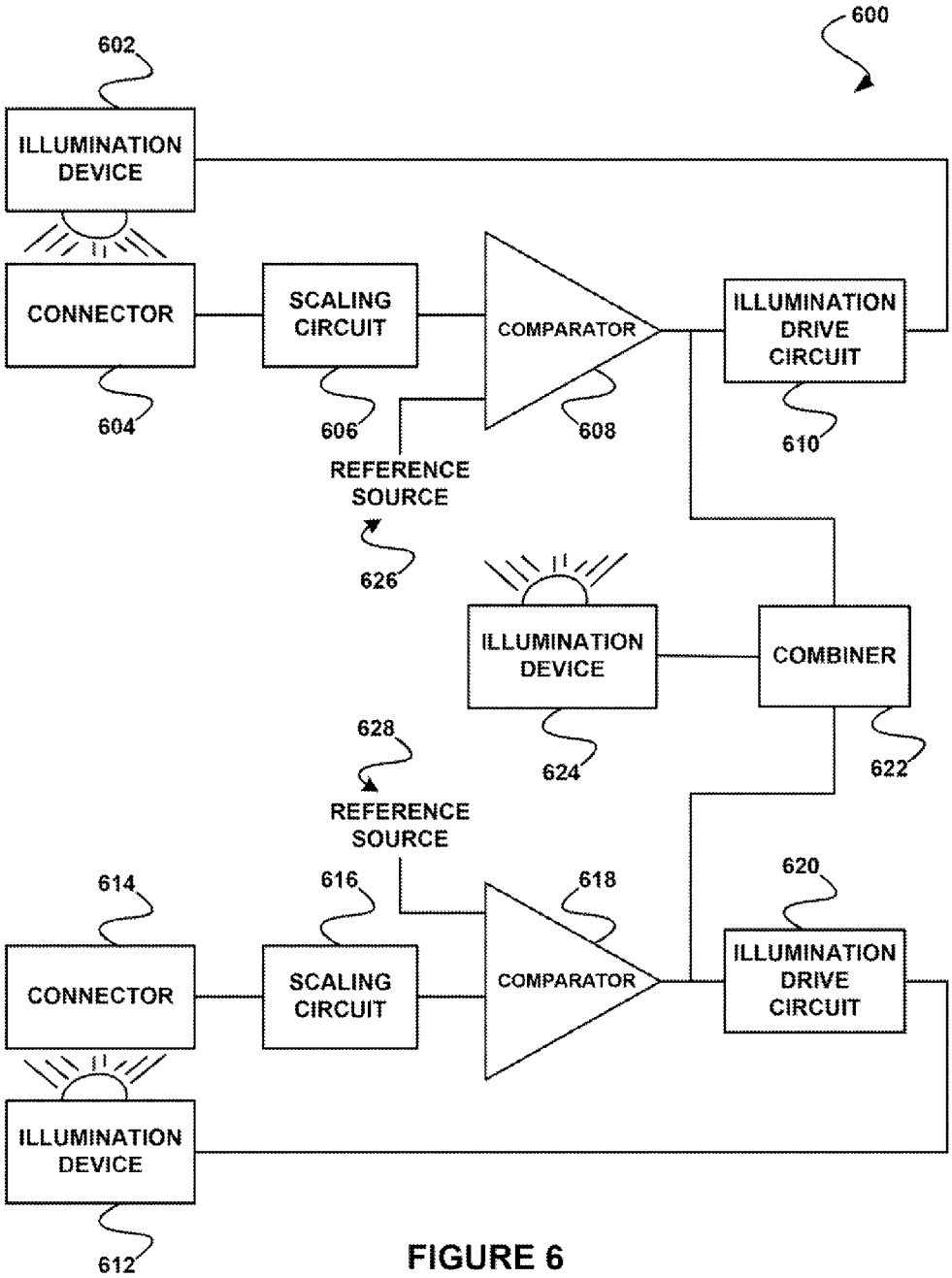
FIG. 6 shows an apparatus for actuating an illumination device, based on a combined connector status associated with two other illumination devices, in accordance with another embodiment.

FIG. 6 shows an apparatus 600 for actuating an illumination device, based on a combined connector status associated with two other illumination devices, in accordance with another embodiment. As an option, the apparatus 600 may be implemented in the context of the functionality and architecture of FIGS. 1-5. Of course, however, the apparatus 600 may be implemented in any desired environment. Again, it should be noted that the aforementioned definitions may apply during the present description.

As shown, the system 600 includes a first illumination device 602. Further, the first illumination device 602 may optionally illuminate a first connector 604. For example, the first connector 604 may be transparent for illumination thereof via the first illumination device 602. Thus, when the first illumination device 602 is actuated, the first connector 604 may be illuminated. As an option, the first illumination device 602 may be external to the first connector 604. In addition, as yet another option, the first illumination device 602 may be internal to the first connector 604.

As also shown, the first connector 604 is coupled to a first scaling circuit 606. For example, the first scaling circuit 606 may process an incoming signal from the first connector 604. Optionally, the processing may include scaling the incoming signal from the first connector 606. As an option, the scaling may include reducing or increasing the incoming signal. For example, the scaling may include reducing or increasing the incoming signal to an input range of a first comparator 608. Further, the incoming signal may include a power signal, an audio signal, a data signal, etc. received by the first connector 604 via an input line.

In yet another embodiment, the first scaling circuit 606 is coupled to the first comparator 608. For example, the first comparator 608 may receive an output signal from the first scaling circuit 606. As an option, the first comparator 608 may compare the output signal received from the first scaling circuit 606 against a signal associated with a first reference source 626. Thus, the first reference source 626 may indicate a predefined reference signal, such as a predefined reference voltage. For example, the predefined reference voltage may be 12 volts or any other voltage value.

In one embodiment, the first reference source 626 may indicate the desired output signal from the first scaling circuit 606. Furthermore, in one embodiment, the first comparator 608 may compare the output signal received from the first scaling circuit 606 to the signal associated with the first reference source 626. Optionally, if the output signal received from the first scaling circuit 606 falls within a range indicated by such signal associated with the first reference source 626, the first comparator 608 may output a signal indicating that the output signal from the first scaling circuit 606 is within the range. Further, as yet another option, if the output signal received from the first scaling circuit 606 falls outside the range indicated by the signal associated with of the first reference source 626, the first comparator 608 may output a signal indicating that the output signal from the first scaling circuit 606 is outside of the range.

In addition, in another embodiment, the signal from the first comparator 606 may instruct the first illumination device 602 to provide a green illumination or a red illumination. Just by way of example, if the output signal received from the first scaling circuit 606 falls within the range indicated by the signal associated with the first reference source 626, the first comparator 608 may output a signal indicating that the first illumination device 602 is to actuate a green LED. As another example, if the output signal received from the first scaling circuit 606 falls within outside of the range indicated by the signal associated with the first reference source 626, the first comparator 608 may output a signal indicating that the first illumination device 602 is to actuate a red LED.

For example, the first comparator 608 may be coupled to a first illumination drive circuit 610. As an option, the first illumination drive circuit 610 may receive the signal from the first comparator 606. Further, as yet another option, the first illumination drive circuit 610 may provide additional power necessary to actuate the first illumination device 602. For example, if the first illumination device 602 requires additional power beyond what is provided by the signal received from the first comparator 606, the illumination drive circuit may be utilized to provide additional power to the first illumination device 602. Still, in yet another embodiment, the first illumination device 602 may receive the signal from the first comparator 608 via the first illumination drive circuit 610. Optionally, after receiving the signal, the first illumination device 602 may illuminate a red LED or a green LED, based on the signal.

In another embodiment, the system 600 further includes a second connector 614. As shown, the second connector 614 is coupled to a second scaling circuit 616. Optionally, the second scaling circuit 616 may process a signal received from the second connector 614 to scale the signal to a second input range of a second comparator 618. Moreover, the second scaling circuit 616 is coupled to the second comparator 618. As an option, the second comparator 618 may compare the signal received from the second scaling circuit 616 against a signal associated with a second reference source 628 for determining whether the signal received from the second connector 614 is within a range indicated by the signal associated with the second reference source 628.

Furthermore, in another embodiment, the second comparator 618 is coupled to a second illumination drive circuit 620. As an option, the second illumination drive circuit 620 may receive a signal from the second comparator 618 indicating whether the signal received from the second connector 614 is within a range indicated by the signal associated with the second reference source 628. For example, the signal from the second comparator 618 may instruct a second illumination device 612 to provide a green illumination or a red illumination. Just by way of example, if the output signal received from the second scaling circuit 616 falls within the range indicated by the signal associated with the second reference source 628, the second comparator 618 may output a signal indicating that the second illumination device 612 is to actuate a green LED. As another example, if the output signal received from the second scaling circuit 616 falls within outside of the range indicated by the signal associated with the second reference source 628, the second comparator 618 may output a signal indicating that the second illumination device 612 is to actuate a red LED.

Further, as yet another option, the second illumination drive circuit 620 may provide additional power necessary to actuate the second illumination device 612. Still, in yet another embodiment, the second illumination device 612 may receive the signal from the second comparator 618 via the second illumination drive circuit 620. Optionally, after receiving the signal, the second illumination device 612 may illuminate at least one second red LED or at least one second green LED associated with second illumination device 612, based on the signal. Further, in still yet another embodiment, the second illumination device 612 may illuminate the second connector 614.

Furthermore, in one embodiment, a combiner 622 may receive the signal from the first comparator 608 and the signal from the second comparator 618. In another embodiment, the combiner 622 may combine such signals to determine an output signal. Optionally, if one of the signals indicates that the first green LED is to be illuminated, and the other signal indicates that the second green LED is to be illuminated, then the output signal from the combiner 622 may instruct a third green LED of a third illumination device 624 to be illuminated. Further, as yet another option, if either of the signals indicates that a red LED is to be illuminated, then the output signal from the combiner 622 may instruct a third red LED of the third illumination device 624 to be illuminated.

Figure 7:
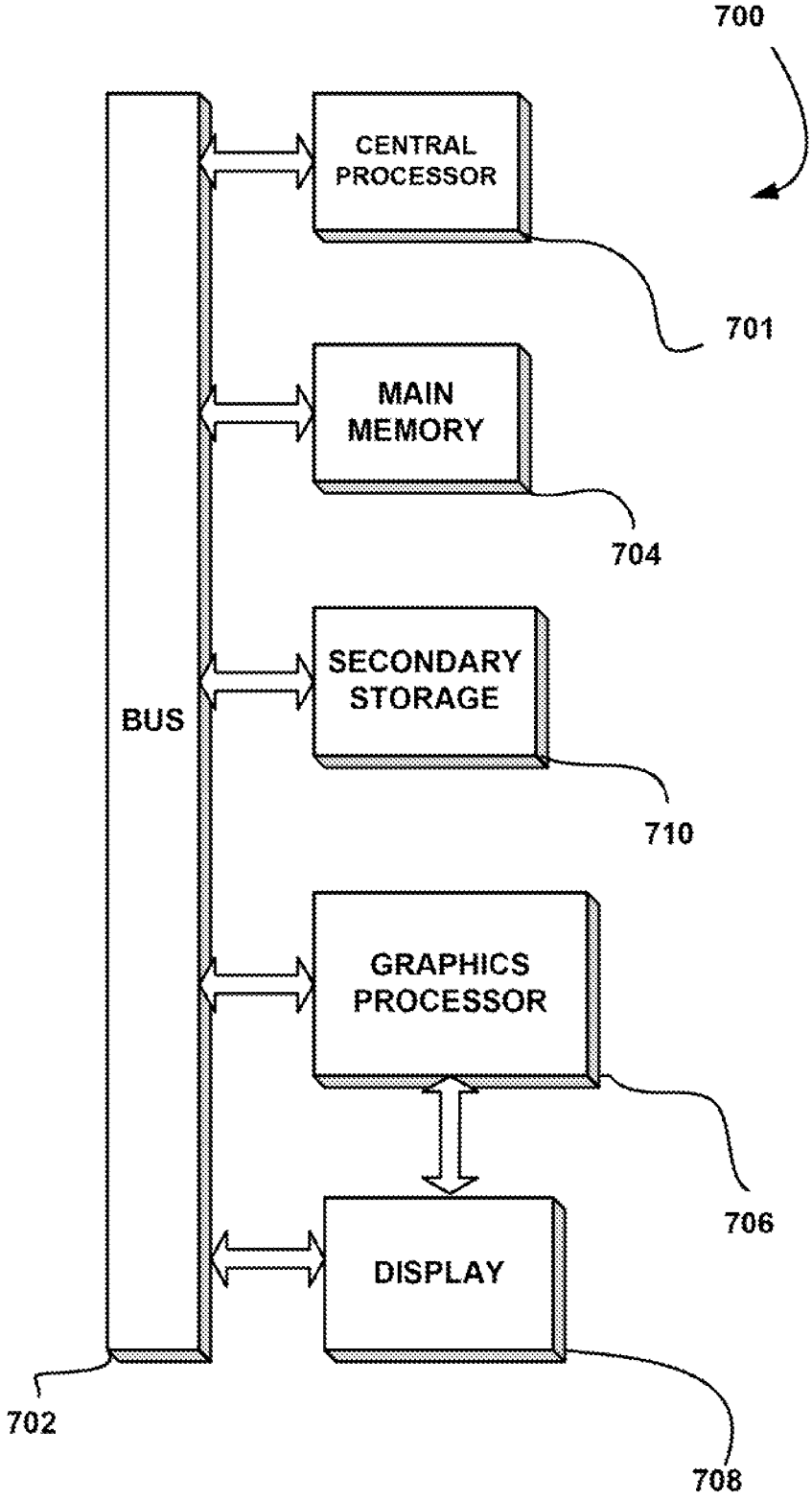
FIG. 7 illustrates an exemplary system in which the various architecture and/or functionality of the various previous embodiments may be implemented.

FIG. 7 illustrates an exemplary system 700 in which the various architecture and/or functionality of the various previous embodiments may be implemented. As shown, a system 700 is provided including at least one host processor 701, which is connected to a communication bus 702. The system 700 also includes a main memory 704. Control logic (software) and data are stored in the main memory 704 which may take the form of random access memory (RAM).

The system 700 also includes a graphics processor 706 and a display 708, i.e. a computer monitor. In one embodiment, the graphics processor 706 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 700 may also include a secondary storage 710. The secondary storage 710 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 704 and/or the secondary storage 710. Such computer programs, when executed, enable the system 700 to perform various functions. Memory 704, storage 710 and/or any other storage are possible examples of computer-readable media.

In one embodiment, the architecture and/or functionality of the various previous figures may be implemented in the context of the host processor 701, graphics processor 706, an integrated circuit (not shown) that is capable of at least a portion of the capabilities of both the host processor 701 and the graphics processor 706, a chipset (i.e. a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 700 may take the form of a desktop computer, lap-top computer, and/or any other type of logic. Still yet, the system 700 may take the form of various other devices including, but not limited to, a personal digital assistant (PDA) device, a mobile phone device, a television, etc.

Further, while not shown, the system 700 may be coupled to a network [e.g. a telecommunications network, local area network (LAN), wireless network, wide area network (WAN) such as the Internet, peer-to-peer network, cable network, etc.) for communication purposes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

determining a status of a connector adapted for being releasably connected to an input line; and conditionally actuating an illuminator, based on the status;

wherein a pair of connectors are included, each adapted for being releasably connected to a corresponding input line, and a pair of illuminators are conditionally actuated, based on the status of each of the connectors;

wherein a third illuminator is included for being conditionally actuated, based on a combined status of the connectors.

2. The method of claim 1, wherein the input line includes a power input line.

3. The method of claim 1, wherein the input line includes a data input line.

4. The method of claim 1, wherein the status reflects a connectivity with the input line.

5. The method of claim 1, wherein the status reflects whether a voltage of the input line falls within a predetermined range.

6. The method of claim 1, wherein the connector is a component of a computer.

7. The method of claim 1, wherein the connector is a component of a graphics card.

8. The method of claim 1, wherein the connector is translucent.

9. The method of claim 1, wherein the illuminator includes at least one light emitting diode.

10. The method of claim 1, wherein the illuminator illuminates the connector.

11. The method of claim 1, wherein the illuminator is color-coded.

12. The method of claim 1, wherein the illuminator is actuated with different colors, based on the status.

13. A computer program product embodied on a computer readable medium, comprising:

computer code for determining a status of a connector adapted for being releasably connected to an input line; and computer code for conditionally actuating an illuminator, based on the status;

wherein a pair of connectors are included, each adapted for being releasably connected to a corresponding input line, and the computer program product is operable such that a pair of illuminators are conditionally actuated, based on the status of each of the connectors;

wherein the computer program product is operable such that a third illuminator is included for being conditionally actuated, based on a combined status of the connectors.

14. An apparatus, comprising:

a circuit for determining a status of a connector adapted for being releasably connected to an input line; and an illuminator for being conditionally actuated, based on the status;

wherein a pair of connectors are included, each adapted for being releasably connected to a corresponding input line, and the apparatus further comprises a pair of illuminators that are conditionally actuated, based on the status of each of the connectors;

wherein the apparatus further comprises a third illuminator for being conditionally actuated, based on a combined status of the connectors.

15. The apparatus of claim 14, wherein the circuit remains in communication with a graphics card.

16. The apparatus of claim 15, and further comprising a memory and a display coupled to the graphics card via a bus.

17. The method of claim 1, wherein a particular color light of the third illuminator is illuminated if it is determined that the status of each of the connectors indicate that voltages associated with the corresponding input lines are within a predetermined range.

18. The method of claim 1, wherein a particular color light of the third illuminator is illuminated if it is determined that the status of each of the connectors indicate that the pair of connectors and their corresponding input lines are connected.

19. The method of claim 1, wherein a particular color light of the third illuminator is illuminated if it is determined that the particular color light is illuminated for the pair of illuminators.

* * * * *